US005803829A

United States Patent [19]

Hayashi

[11] Patent Number: 5,803,829

[45] Date of Patent: Sep. 8, 1998

[54] GOLF CLUB

[75] Inventor: Toshiaki Hayashi, Sanjo, Japan

[73] Assignee: S.I.N.C. Corporation, Sanjo, Japan

[21] Appl. No.: 865,515

[22] Filed: May 29, 1997

[30] Foreign Application Priority Data

Mar. 27, 1997 [JP] Japan ..... 9-074880

[51] Int. Cl.[6] ..... A63B 53/08; A63B 69/36

[52] U.S. Cl. ..... 473/326; 473/333

[58] Field of Search ..... 473/282, 297, 473/316, 326, 333

[56] References Cited

U.S. PATENT DOCUMENTS

| | | | |
|---|---|---|---|
| 1,561,595 | 11/1925 | Davis | 473/326 |
| 1,894,841 | 1/1933 | Adams | 473/326 |
| 2,432,450 | 12/1947 | Sears | 473/297 |
| 3,037,775 | 6/1962 | Busch | 473/326 |
| 3,516,673 | 6/1970 | Estes | 473/256 |
| 3,993,314 | 11/1976 | Harrington et al. | 473/326 |
| 4,541,631 | 9/1985 | Sasse | 473/297 |
| 5,082,279 | 1/1992 | Hull et al. | 473/297 |

FOREIGN PATENT DOCUMENTS

| | | | |
|---|---|---|---|
| 971197 | 7/1975 | Canada | 273/170 |
| 2167966 | 6/1986 | United Kingdom | 273/170 |
| 2200560 | 8/1988 | United Kingdom | 273/171 |
| 092008521 | 5/1992 | WIPO | 273/171 |

*Primary Examiner*—Sebastiano Passaniti
*Attorney, Agent, or Firm*—Kanesaka & Takeuchi

[57] ABSTRACT

A golf club of the invention is basically formed of a head, grip and shaft for connecting the head and grip. The head of the golf club has a sweet spot on a face surface thereof. A hollow passage extending through the grip, shaft and head is formed in the golf club, and reaches a location behind the sweet spot at the face surface of the head. Weighted materials, such as iron beads are contained in the hollow passage. When the golf club is swung to a top of back swing, the iron beads are positioned adjacent the forward end of the grip, i.e., such as the lowest end of the golf club. However, when the golf club is swung to a point of impact, the iron beads, or other materials reach the sweet spot at a high speed in receipt of a centrifugal force of the golf club to thereby increase a driving force to be applied to a ball. Thus, a flying distance of the ball can be greatly increased without changing the exterior shape or material of the face surface of the head.

8 Claims, 3 Drawing Sheets

GOLF CLUB

Background of the Invention and Related Art Statement

The present invention relates to a structure of a golf club.

A golf club has an area which is called a sweet spot. When a golf ball is driven by the area of the golf club, the maximum flying distance of the ball can be obtained.

Heretofore, in order to obtain a longer flying distance of the ball, various attempts have been made such that an area of the sweet spot of the golf club is made larger; a shape of the sweet spot is changed; or the sweet spot is located at a specific position. Almost all of the attempts relate to the shape or the material of a face surface, i.e., the surface by which the ball is hit. More specifically, the shape of the face surface of the head is changed or a special metal is used for the face surface, so that when the ball is driven by the sweet spot, the flying distance of the ball can be increased.

However, a large number of inventions relating to the face surface of the head have been made, so that changes in the shape and material of the face surface of the head have reached a limit. Therefore, it is anticipated that the flying distance of the ball is increased from aspects other than changes of the shape and material of the face surface.

Accordingly, an object of the present invention is to provide a golf club capable of increasing the flying distance of the golf ball without changing the shape and material of the face surface of the head.

Another object of the present invention is to provide a golf club as stated above, wherein the weight of the golf club itself can be reduced.

A further object of the present invention is to provide a golf club as stated above, wherein a movable material to be contained in the golf club can be selected from a large variety of materials.

A still further object of the present invention is to provide a golf club as stated above, wherein a part of a grip of the club can be removed from the golf club to adjust or change a quantity of the movable material contained in the club.

Further objects and advantages of the invention will be apparent from the following description of the invention.

SUMMARY OF THE INVENTION

In order to attain the above objects in a golf club of the present invention, the inner structure of a head of the golf club has been improved without changing the shape or material of a face surface of the head to cause an increase in a flying distance of a golf ball.

According to one aspect of the present invention, a golf club is formed of a head, a grip and a shaft for connecting the head and the grip. The grip and shaft are hollow and communicated with each other. A passage is formed in the head along a front surface of the head and is extended to surround at least a sweet spot in the head. The passage is in communication with the hollow shaft and grip to form a hollow passage through the club. Movable material is contained in the hollow passage to move therein so that when the golf club is swung, the movable material is moved in an interior of the hollow passage, and in correspondence therewith, the center of gravity of the golf club is consequently moved.

While an appearance of the golf club of the invention is the same as that of a conventional golf club, the inner structures of the grip, shaft and head are different from those of the conventional golf club. More specifically, the hollow passage is formed in the grip, shaft and head of the golf club of the present invention, and the movable material, such as iron beads described later, is contained in the hollow passage in a predetermined quantity. The movable material reacts to gravity and centrifugal force of the club when the club is swung, so that the movable material can be freely moved from the hollow passage formed in the head to the hollow passage formed in the grip through the hollow passage in the shaft.

At a set-up point of the golf club, the movable material in the golf club is acted upon by gravity to remain in the hollow portion of the head. When the player starts to swing the golf club upwardly during a backswing, the movable material receives the action of gravity to move from the raised head down to the grip through the hollow shaft. When the golf club is swung back to a top position, the movable material reaches the end of the grip. Thereafter, when the player starts to swing the golf club downwardly, the movable material is acted upon by centrifugal force to start moving from the grip to the head through the hollow shaft at a high speed.

At a point of impact of the golf club with a golf ball, the movable material again reaches the passage in the head. The passage is formed to cover the sweet spot on the face surface of the head so that, at the point of impact, forces corresponding to mass and acceleration of the movable material are transmitted to the ball through the face surface of the head. More specifically, a force corresponding to the mass and acceleration of the movable material is applied to the ball in addition to a force corresponding to the mass and acceleration of the golf club itself, so that driving force to be applied to the ball may be doubled, or increased even greater. Thus, a flying distance of the ball is greatly increased.

The movable material to be contained in the hollow passage may be any material which can be moved in the hollow passage. However, in view of practical use, it is preferable that the movable material is any one of solid, liquid and fluid, or mixtures thereof. As the solid, a single metal, such as iron and titanium, or a superalloy may be used. But the solid is not limited to these metals. As the liquid, any kind liquid, such as water, may be used. As the fluid, for example, mercury may be used. As mentioned above, a mixture of the solid, liquid and fluid may be used. For example, a fluid material as a mixture of the solid and the liquid may be used.

The shape of the movable material is not specifically limited. The movable material may take any shape if the movable material can be freely moved in the hollow passage. However, the most suitable shape is spherical which has least resistance when moved. Or, the movable material may have a small particle shape.

A quantity of the movable material to be contained in the hollow passage is determined based on elements, such as the weight of the golf club itself and the specific gravity of the movable material. More specifically, the whole weight of the movable material is determined so that a center of gravity with respect to a sum of the respective weights of the golf club and the movable material at a time of swing of the golf club is moved in the golf club corresponding to swing thereof. Once the whole weight of the movable material is determined, the quantity of the movable material can be obtained by dividing the whole weight with the specific gravity of the movable material. Therefore, in case the weight of the golf club itself is less, the whole weight of the movable material, i.e. the quantity of the movable material, can be set less. On the contrary, in case the weight of the golf club itself is larger, the whole weight of the movable material, i.e. the quantity of the movable material, has to be set larger.

In case a solid, such as metal beads, is used as the movable material, it is preferable that the solid has a small kinematic friction coefficient of a surface of the solid with respect to the inner wall of the golf club. If the solid has the small kinematic friction coefficient, the movable material can be more smoothly moved in the hollow passage.

In the same manner, in case a solid is used as the movable material, it is preferable that the movable material has a high rebound coefficient. As the rebound coefficient of the movable material is larger, the movable material rebounds higher when the movable material collides against the inner wall of the hollow passage, so that the movable material can be moved actively in the hollow passage to allow the center of gravity of the golf club to move smoothly during the swing.

Also, the shape of the passage formed in the head is not specifically limited. Any shape in which the movable material can be freely moved may be used. Therefore, shapes formed by combining straight lines, such as rectangle and triangle; curved shapes, such as circle and semicircle; or shapes formed by combining straight lines and curved lines may be used.

The head of the golf club may be formed of a solid member or a hollow member. In case a hollow head is formed, the passage in the head is formed by being separated with a wall member from the surroundings. As described above, by making the head hollow, the weight of the golf club itself can be reduced. As a result, when compared to a case where the golf club is formed of a solid member, the center position of gravity of the golf club can be varied by a lesser quantity of the movable material, so that the center of gravity of the golf club can be easily moved during the swing.

Further, it is desirable that the golf club is partially detachable at the grip portion. For example, one end of the grip, i.e., one end of the golf club itself, can be provided with a thread and a screw is screwed therein to freely open and close the end of the grip, and to close the hollow passage with the screw. Alternatively, the grip itself may be screwed into the shaft to close the hollow passage. As described above, by detachably forming at least a part of the grip, a quantity of the movable material to be contained in the hollow passage can be easily adjusted.

DETAILED DESCRIPTION OF PREFERRED EMBODIMENTS

Figure 1:
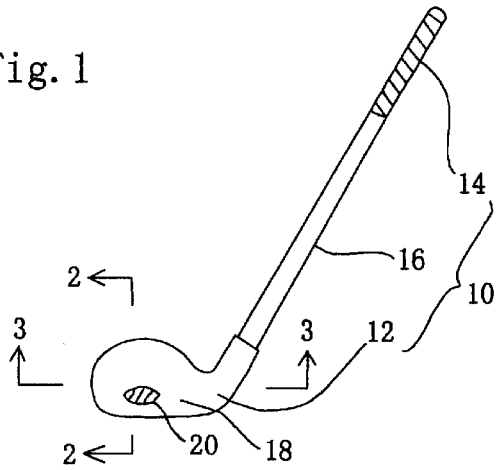
FIG. 1 is a front elevation of a golf club of a first embodiment according to the present invention.

FIGS. 1 to 4 show a first embodiment of a golf club according to the present invention, wherein a driver is used as the golf club. As shown in FIG. 1, a golf club 10 of a first embodiment comprises a head 12, a grip 14 and a shaft 16 connecting the head 12 and the grip 14 therebetween. A front surface, i.e., face surface 18 of the head 12 includes a sweet spot 20. It is assumed that the shape, size and position of the sweet spot 20 have already been determined through experiments.

Figure 4:
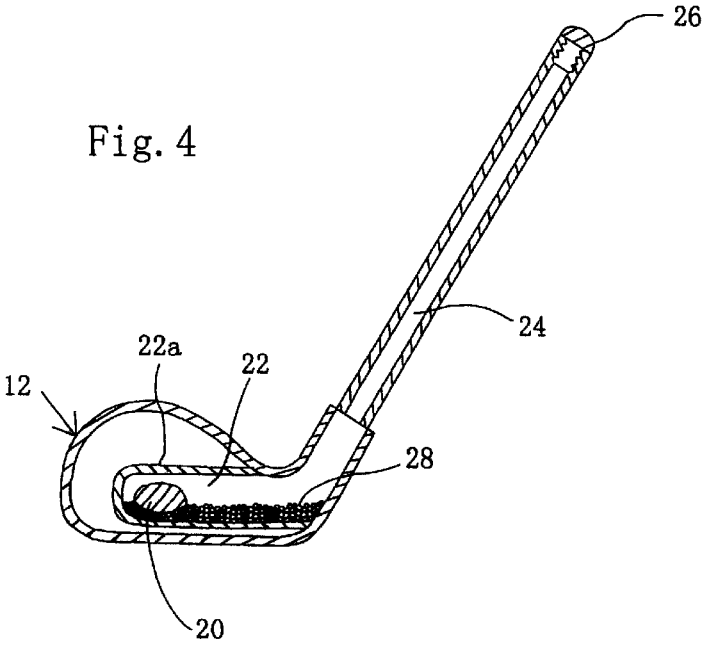
FIG. 4 is a longitudinal, sectional view for showing an inner structure of the golf club shown in FIG. 1 when the golf club is viewed from the same direction as in FIG. 1.

FIG. 4 is a schematic view for showing an inner structure of the golf club 10 when the golf club 10 is viewed from the same direction as that in FIG. 1. As shown in FIG. 4, the grip 14 and the shaft 16 are formed in a hollow shape and communicated with each other in interiors thereof.

Figure 2:
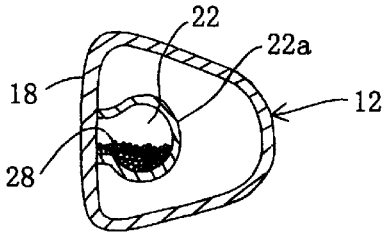
FIG. 2 is a sectional view taken along line 2—2 in FIG. 1.
Figure 3:
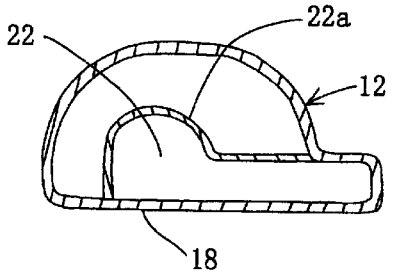
FIG. 3 is a sectional view taken along line 3—3 in FIG. 1.

As shown in FIGS. 2 and 3, an interior of the head 12 is also formed in a hollow shape as in the grip 14 and the shaft 16. Further, the head 12 is provided with a passage 22 therein. The passage 22 is separated from surroundings by a wall member 22*a* to form a closed space.

As shown in FIG. 4, the passage 22 extends to a position covering the sweet spot 20 formed in the face surface 18 on a back side thereof and covers a whole area of the sweet spot 20 on the back side of the face surface 18.

Also, as shown in FIG. 4, the passage 22 is in communication with the hollow spaces formed in the shaft 16 and the grip 14 to form a continuous hollow passage 24. Therefore, the hollow passage 24 extends from a forward end of the grip 14 to the sweet spot 20 of the head 12.

The forward end of the grip 14 has an opening portion into which a screw 26 is screwed. With the screw 26, the hollow passage 24 forms a closed passage in the golf club 10. When the screw 26 is removed, the hollow passage 24 communicates with the atmosphere at the opening portion of the grip 14.

A number of iron beads 28 (shown only in FIGS. 2 and 4) having a small diameter are contained in the hollow passage 24. Surfaces of the iron beads 28 are polished so that a kinematic friction coefficient between the surfaces of the iron beads 28 and an inner surface of the wall member 22*a* of the passage 22 becomes small. In the same manner, the inner surface of the wall member 22*a* is polished, or coated with a thin film having a small friction coefficient, so that the kinematic friction coefficient between the iron beads 28 and the inner surface of the wall member 22*a* is made small.

The plural iron beads 28 are freely moved in the hollow passage 24 from the head 12 to the screw 26 at the forward end of the grip 14, while rolling or sliding.

As far as the iron beads 28 can be freely moved in the hollow passage 24, the size of the iron beads 28 is not specifically limited. Also, the size of all the iron beads 28 need not be the same.

The number of the iron beads 28 to be contained in the hollow passage 24 is determined in the following manner. As described later, when the golf club 10 is swung, the iron beads 28 are moved in the hollow passage 24 corresponding to a track of the swing. A gross weight of the iron beads 28 is obtained so that the center of gravity with respect to the weight of the whole golf club 10, i.e., a sum of the weight of the golf club 10 itself and a weight of the iron beads 28, is moved according to the movement of the iron beads 28 corresponding to the swing of the golf club. Once the preferred gross weight of the iron beads 28 is determined, the number of the iron beads 28 to be contained in the hollow passage 24 can be obtained by dividing the gross weight with a specific gravity of the iron beads 28.

The iron beads 28 can be inserted into the hollow passage 24 through the opening portion of the grip 14 by removing the screw 26. Also, the number of the iron beads 28 can be freely controlled through the opening portion of the grip 14.

Figure 5:
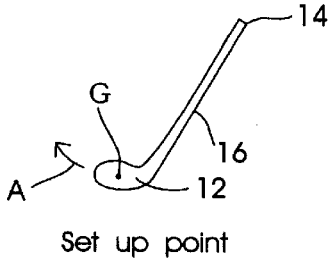
FIGS. 5(*a*) through 5(*l*) are sequential views for showing movements of the center of gravity of the golf club as moveable material changes location during a conventional golf swing.
Figure 5:
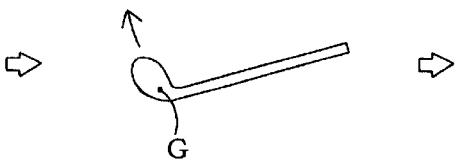
Figure 5:
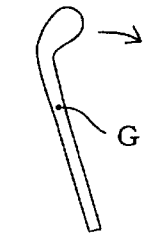
Figure 5:
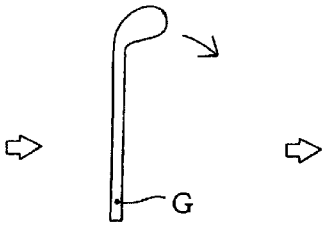
Figure 5:
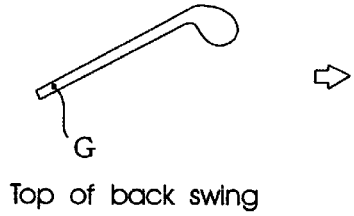
Figure 5:
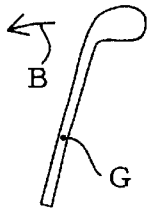
Figure 5:
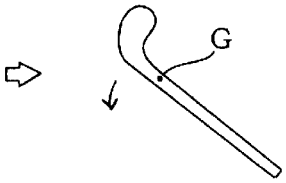
Figure 5:
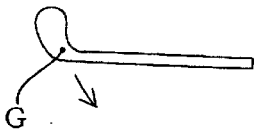
Figure 5:
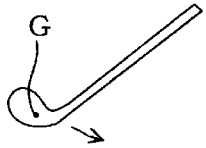
Figure 5:
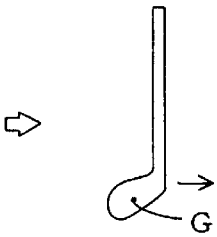
Figure 5:
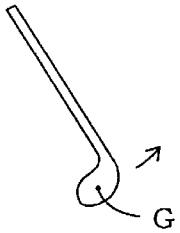
Figure 5:
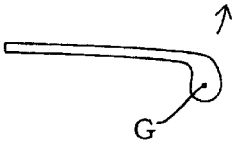

FIGS. 5(*a*) through 5(*l*) show states where the center of gravity of the golf club 10 is moved when the golf club 10 is swung. First, at a set-up point of the golf club, as shown in FIG. 5(*a*), the iron beads 28 are collected in the passage 22 of the head 12 as a result of gravity. Thus, the center of gravity G of the golf club 10 is located at the approximate center of the head 12.

Then, when a player starts a back swing in the direction of arrow A and the golf club 10 is lifted up, the iron beads 28 are moved from the head 12 to the grip 14 through the shaft 16 to move downward corresponding to a track of the swing. In association therewith, the center of gravity G of the golf club 10 is also moved from the head 12 toward the grip 14 along the shaft 16 as shown in FIGS.5(*b*) and 5(*c*).

As shown in FIG. 5(*d*), when the head 12 is located at the uppermost position and the grip 14 is located at the lowermost position, the iron beads 28 reach the foremost edge, such as an area adjacent to the screw 26, of the grip 14, and the center of gravity G of the golf club 10 is also moved to a position near the foremost edge of the grip 14. Thereafter, during a time period when the golf club 10 reaches the top of the back swing as shown in FIG. 5(*e*) from the stage in FIG. 5(*d*), center of gravity of the iron beads 28 and the golf club 10 remain at the foremost position of the grip 14 and do not move.

After the top of the back swing in FIG. 5(*e*), as shown by a stage in FIG. 5(*f*) and consecutive stages thereafter, the golf club 10 starts being swung along a parabolic track in an arrow B direction. During the swinging, as shown by stages in FIGS. 5(*g*) to (*i*), the iron beads 28 in the hollow passage 24 are moved at a great speed in a direction from the grip 14 to the head 12 through the shaft 16 as a result of centrifugal force acting upon the golf club.

At a point of impact as shown in FIG. 5(*j*), the iron beads 28 reach the passage 22 of the head 12, and then reach the area surrounding the sweet spot 20 in the face surface 18 of the head 12. Therefore, a golf ball receives a force obtained by multiplying the sum of a mass of the golf club 10 and a mass of the iron beads 28 with an acceleration of the head 12 at the point of impact. More specifically, at the point of impact, a force corresponding to the mass and the acceleration of the iron beads 28 is applied to the ball in addition to a force corresponding to the mass and the acceleration of the golf club 10 itself so that the forces are centralized on the ball. Thus, a flying distance of the ball can be increased.

Thereafter, as shown in FIGS. 5(*k*) and 5(*l*), a follow-through of the swing is carried out. During the follow-through, since the iron beads 28 in the hollow passage 24 remain in the head 12 by the action of the centrifugal force, the centrifugal force of the iron beads 28 acts as a force for the follow-through to thereby increase a speed for the follow-through, which results in optimizing the flying distance of the ball.

As described above, according to the golf club 10 of the present embodiment, the force acting on the ball at the point of impact can be greatly increased by a force due to the mass and the acceleration of the iron beads 28 when compared to a conventional golf club. Thus, the flying distance of the ball can be increased.

Also, during that part of the swing from the point as shown in FIG. 5(*f*) to the impact point as shown in FIG. 5(*j*), because the iron beads 28 are moving in the hollow portion from the grip 14 to the shaft 16 and are not located in the head 12, the weight of only the head 12 itself during this part of the swing is less than the weight when the iron beads 28 are located in the head 12. Especially, if the head 12 is hollow, when compared to a head 12 made of a solid member, the golf club is very light. Therefore, a player can swing the head 12 faster, and greater acceleration can be applied to the head 12 at the point of impact, so that the flying distance of the ball can be increased.

In the first embodiment, while the present invention is applied to a driver, the invention can also be applied to clubs described as being an iron club.

FIGS. 6 to 9 show a second embodiment where the present invention is applied to an iron club.

Figure 6:
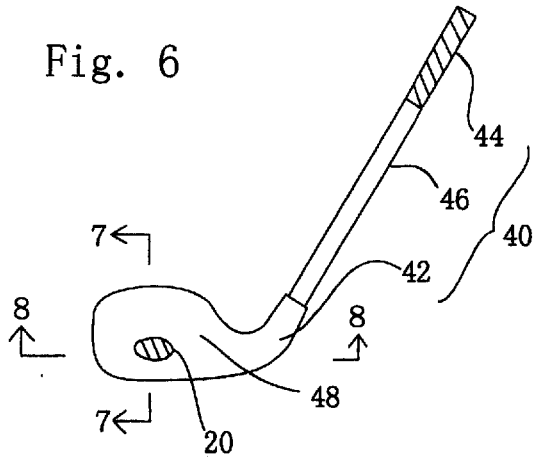
FIG. 6 is a front elevation of a golf club of a second embodiment according to the present invention.
Figure 7:
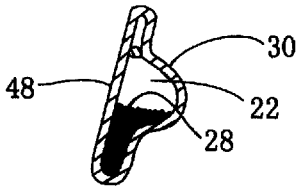
FIG. 7 is a sectional view taken along line 7—7 in FIG. 6.
Figure 8:
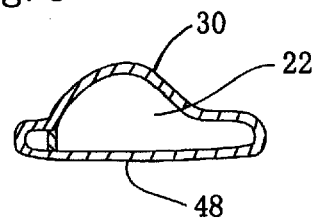
FIG. 8 is a sectional view taken along line 8—8 in FIG. 6.
Figure 9:
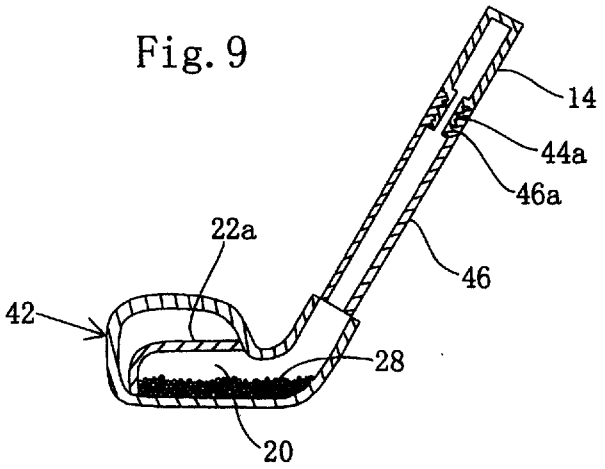
FIG. 9 is a longitudinal, sectional view for showing an inner construction of the golf club as shown in FIG. 6 viewed from the same direction as in FIG. 6.

Since an iron club 40, as shown in FIG. 6, is thin in its head 42 different from a driver head 12, the head 42 of the second embodiment has a projecting portion 30 on a back side thereof, so that a number of iron beads 28 can be centralized on an area surrounding a sweet spot 20 of a face surface 48 of the head 42.

Also, while the grip 14 and the shaft 16 are formed integrally in the first embodiment, in the iron club of the second embodiment, a grip 44 and a shaft 46 are separately formed. Therefore, the grip 44 and shaft 46 are provided with screw portions 44*a*, 46*a* at the respective edge portions to be fitted together. Thus, in the second embodiment, since the grip 44 can be freely removed from the shaft 46, the number of the iron beads 28, or other material to be contained in the hollow passage of shaft 46, can be changed by removing the grip 44 therefrom.

Structures and functions of the golf club in the second embodiment are the same as those of the first embodiment except for the above described points.

As described above, in one aspect of the present invention, when a ball is driven at a point of impact by the golf club of the invention, the ball receives a force brought by the movable material which is moved at a high speed under the influence of centrifugal force created by swinging of the golf club in addition to a force caused by the swing of the golf club itself, so that a flying distance of the ball driven by the sweet spot of the golf club can be greatly increased.

Further, in another aspect of the invention, since the head of the golf club of the invention is formed in a hollow shape, when compared to a golf club having a solid head, a weight of the golf club itself can be reduced, so that the golf club can be swung at a higher speed and the gross weight of movable material to be contained in the golf club can also be reduced.

In still another aspect of the invention, the movable material to be contained in the golf club can be selected from a large variety of materials. Also, the movable material to be contained in the golf club can be formed in the most suitable shape.

Furthermore, by removing the grip of the golf club of the invention, a quantity of the movable material to be contained in the golf club can be freely controlled or changed.

While the invention has been explained with reference to the specific embodiments of the invention, the explanation is illustrative and the present invention is limited only by the appended claims.

What is claimed is:

1. A golf club comprising:

a grip;

a shaft having a hollow portion therein, said shaft being attached to said grip;

a head having a front surface, a sweet spot on the front surface, and a hollow passage formed inside the head and communicating with said hollow portion of said shaft, said hollow passage extending behind the sweet spot and having an enlarged portion behind the sweet spot, which is greater in size than other portions of the hollow passage; and movable material means movable in said hollow passage and hollow portion and being contained therein so that when said golf club is swung, said movable material means is moved in said hollow passage and hollow portion for changing the location of the center of gravity of the golf club, and when the head comes to a point of impact, the movable material means is located in the hollow passage including the enlarged portion behind the sweet spot.

2. A golf club as claimed in claim 1, wherein said head is hollow, and said passage is formed by a wall member.

3. A golf club as claimed in claim 1, wherein said movable material means comprises at least one material selected from a group consisting of solid, liquid and fluid material.

4. A golf club as claimed in claim 1, wherein said movable material means has a spherical shape.

5. A golf club as defined in claim 1, wherein said grip has a hollow portion therein in communication with said hollow portion of said shaft.

6. A golf club as claimed in claim 4, wherein at least a part of said grip is detachable for providing access to the hollow portions of said grip and said shaft.

7. A golf club as defined in claim 1, wherein said enlarged portion has a depth extending rearwardly from the front surface, which is greater than the other portions of the hollow passage.

8. A golf club as defined in claim 7, wherein said enlarged portion has a front side close to the front surface and back side behind the front side, said back side being greater in size then the front side.

* * * * *